US012508467B2

(12) United States Patent
Giannoccaro

(10) Patent No.: US 12,508,467 B2
(45) Date of Patent: Dec. 30, 2025

(54) APPARATUS FOR THE PRACTICE OF PHYSICAL EXERCISES WITH A CABLE STRETCH VARIATION SYSTEM

(71) Applicant: Bruno Rodrigues Giannoccaro, Sao Paulo (BR)

(72) Inventor: Bruno Rodrigues Giannoccaro, Sao Paulo (BR)

( * ) Notice: Subject to any disclaimer, the term of this patent is extended or adjusted under 35 U.S.C. 154(b) by 98 days.

(21) Appl. No.: 18/563,061

(22) PCT Filed: Mar. 27, 2023

(86) PCT No.: PCT/BR2023/050102

§ 371 (c)(1),
(2) Date: Nov. 21, 2023

(87) PCT Pub. No.: WO2023/184004

PCT Pub. Date: Oct. 5, 2023

(65) Prior Publication Data

US 2024/0216747 A1 Jul. 4, 2024

(30) Foreign Application Priority Data

Mar. 28, 2022 (WO) ..... PCT/BR2022/050109

(51) Int. Cl.
*A63B 21/00* (2006.01)
*A63B 21/04* (2006.01)
(Continued)

(52) U.S. Cl.
CPC ..... *A63B 21/154* (2013.01); *A63B 21/00069* (2013.01); *A63B 21/0442* (2013.01); *A63B 21/0552* (2013.01); *A63B 71/0036* (2013.01)

(58) Field of Classification Search
CPC ..... A63B 21/154; A63B 21/00069; A63B 21/0442; A63B 21/0552; A63B 71/0036;
(Continued)

(56) References Cited

U.S. PATENT DOCUMENTS 7,651,443 B1 * 1/2010 Fenster ..... A63B 71/0036 482/37
8,057,367 B2 * 11/2011 Giannelli ..... A63B 21/00076 482/102

(Continued)

FOREIGN PATENT DOCUMENTS

WO 2018089624 A1 5/2018
WO 2020113290 A1 6/2020

*Primary Examiner* — Andrew S Lo
(74) *Attorney, Agent, or Firm* — D'Ambrosio & Menon, PLLC; Usha Menon

(57) ABSTRACT

An apparatus equipped with a cable stretch variation system comprising three horizontal and parallel platforms, vertically movable, together or separately, when pulled by a steel cable "C". Each platform is traversed by the columns and is provided with a respective pulley. On the top platform, mobile carriages are mounted, whose rollers slide vertically along the columns. At least two platforms and are provided with a respective through-hole for inserting a locking selector pin, which is the determining element of the cable stretch variation positions, corresponding to the use of the machine in the 2×1, 4×1 or 6×1 ratios.

13 Claims, 18 Drawing Sheets

(51) Int. Cl.
*A63B 21/055* (2006.01)
*A63B 71/00* (2006.01)

(58) Field of Classification Search
CPC ... A63B 21/156; A63B 23/1209; A63B 21/06; A63B 21/062; A63B 21/0628; A63B 21/4035; A63B 23/035
See application file for complete search history.

(56) References Cited

U.S. PATENT DOCUMENTS

| | | | | |
|---|---|---|---|---|
| 11,065,496 | B2 | 7/2021 | Leipheimer | |
| 11,938,365 | B1 * | 3/2024 | Dorsey | A63B 21/00065 |
| 2013/0296144 | A1 * | 11/2013 | Gvoich | A63B 21/062 482/102 |
| 2015/0182780 | A1 * | 7/2015 | Olson | A63B 21/4029 482/92 |
| 2015/0246258 | A1 * | 9/2015 | Hockridge | A63B 21/156 482/99 |
| 2016/0250514 | A1 * | 9/2016 | Gvoich | A63B 23/03541 482/102 |
| 2019/0099633 | A1 * | 4/2019 | Orady | A63B 21/0058 |
| 2020/0155889 | A1 | 5/2020 | Leipheimer | |
| 2020/0222745 | A1 * | 7/2020 | Leipheimer | A63B 23/03525 |
| 2020/0222748 | A1 * | 7/2020 | Carter | A63B 21/00065 |
| 2021/0283451 | A1 * | 9/2021 | Gvoich | A63B 23/03541 |
| 2022/0118304 | A1 * | 4/2022 | McNally | A63B 21/159 |

* cited by examiner

[Fig. 1]
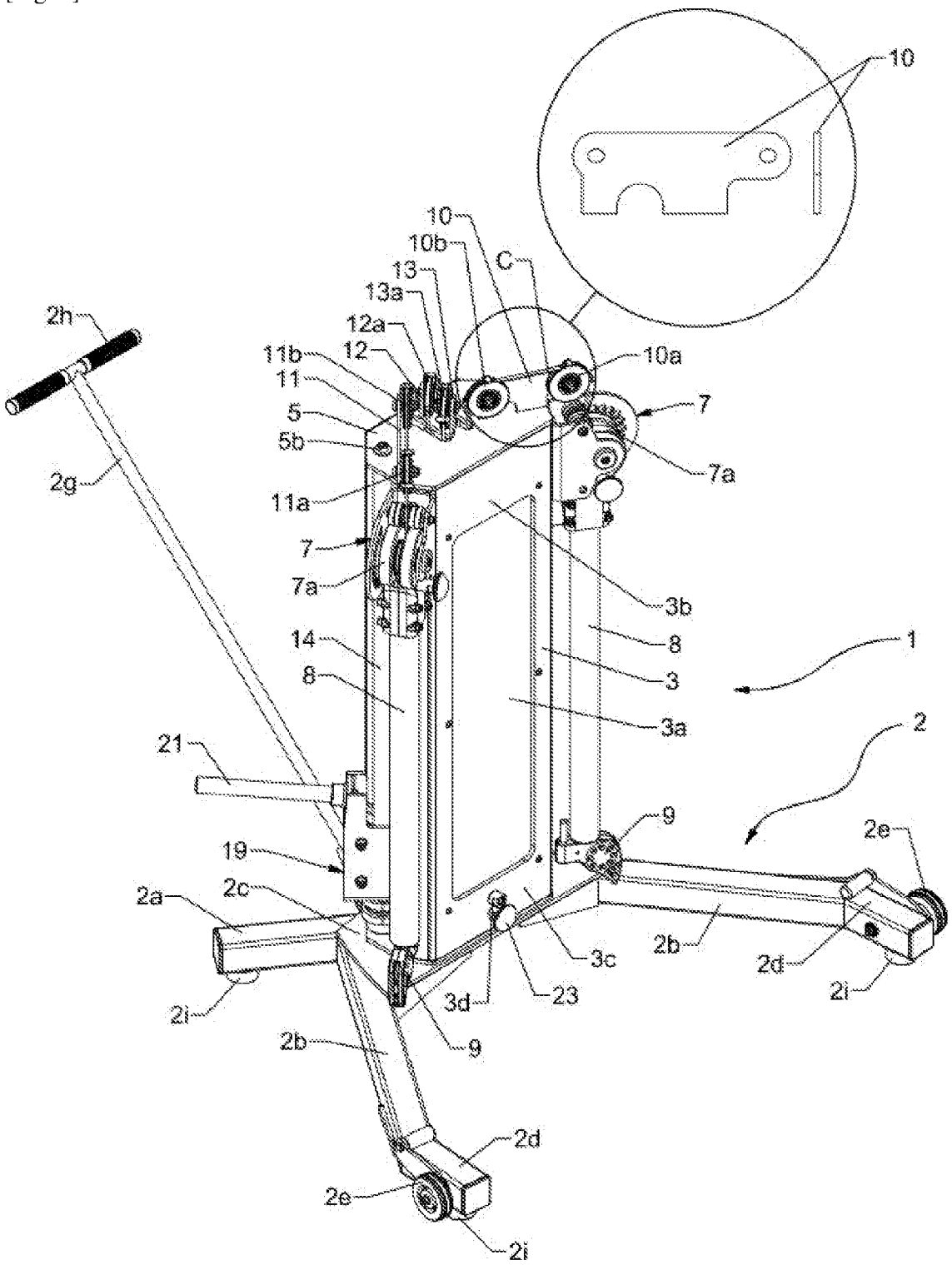

[Fig. 2]
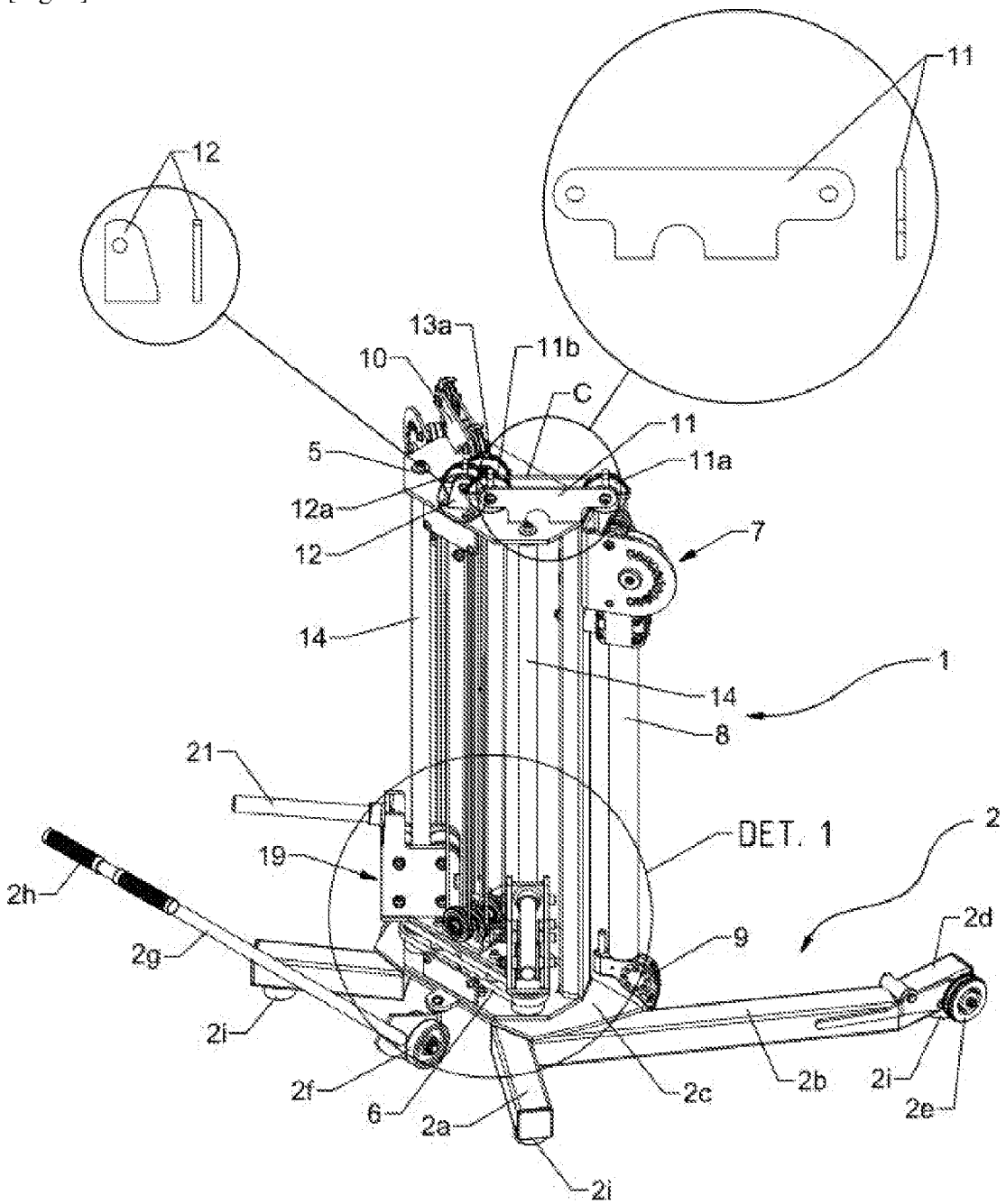

[Fig. 3]
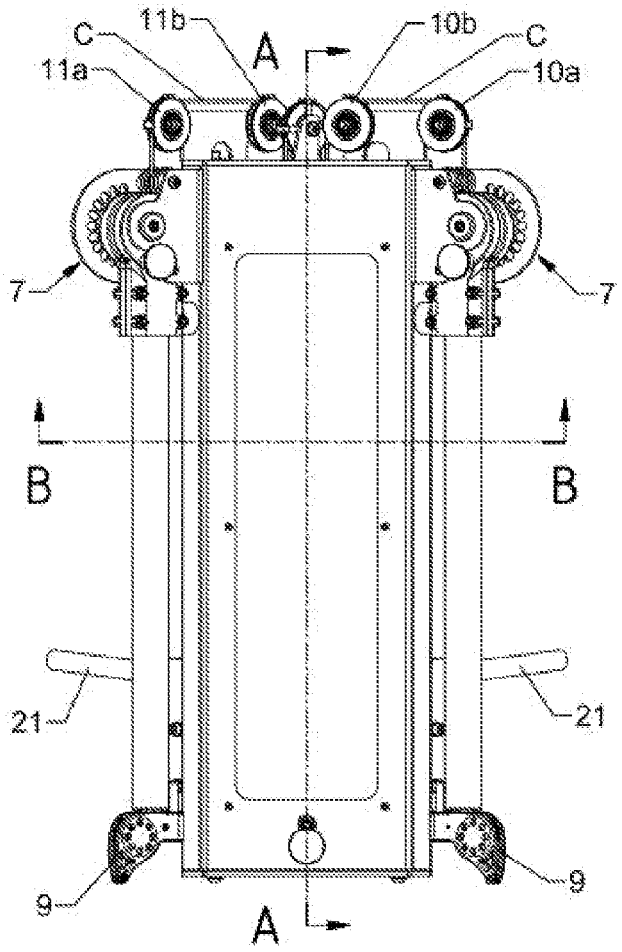

[Fig. 4]
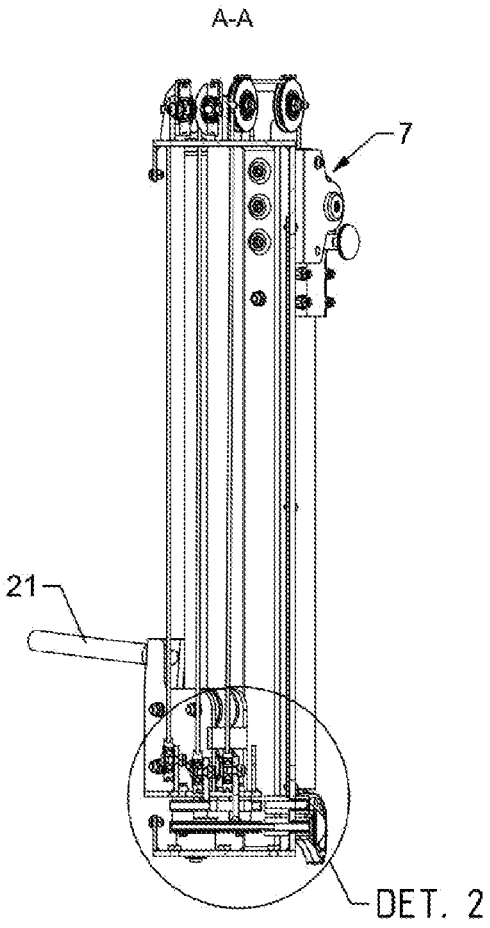
[Fig. 5]
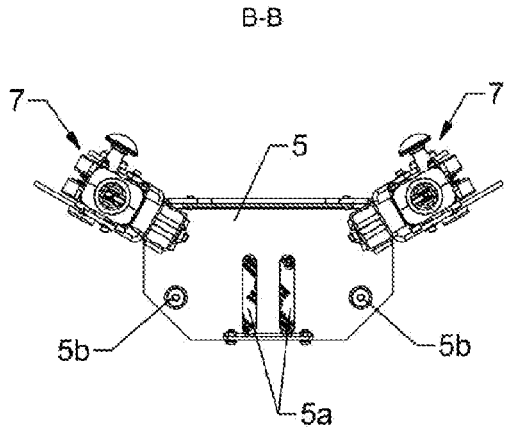

[Fig. 6]
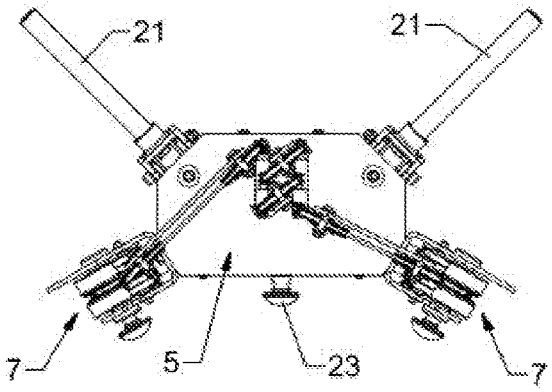
[Fig. 7]
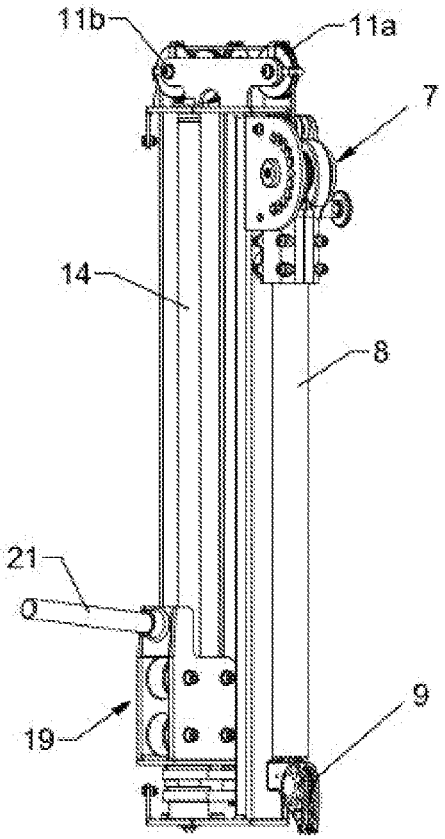

[Fig. 8]
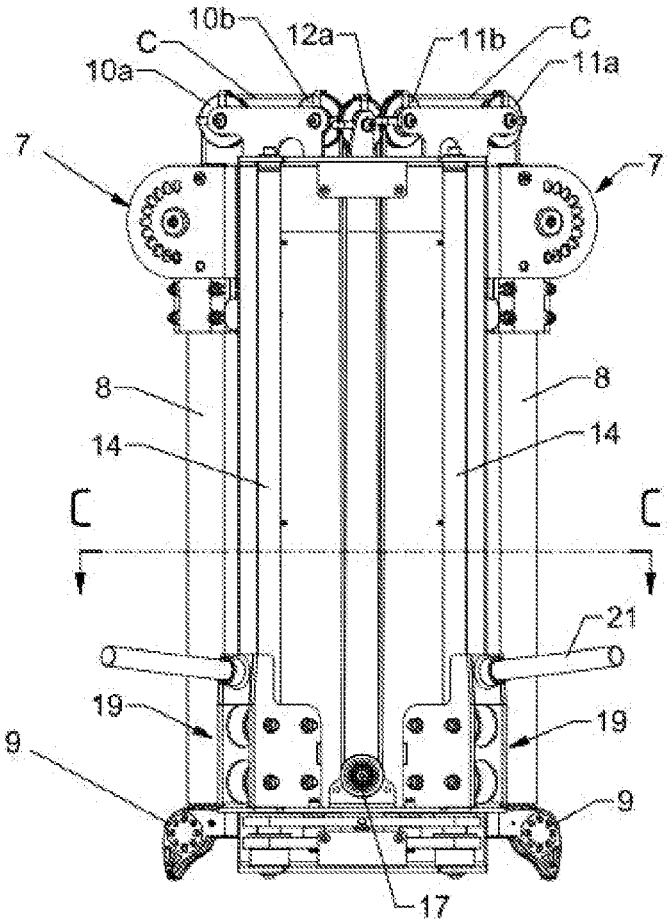
[Fig. 9]
C-C
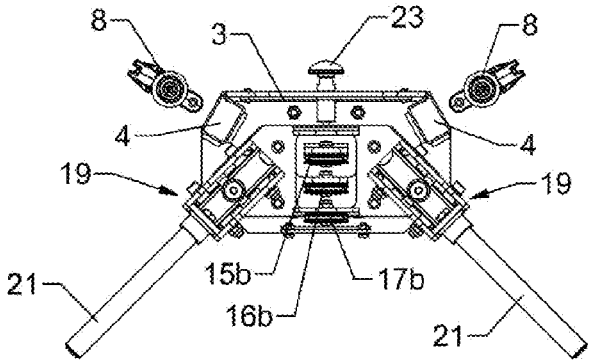

[Fig. 10A]
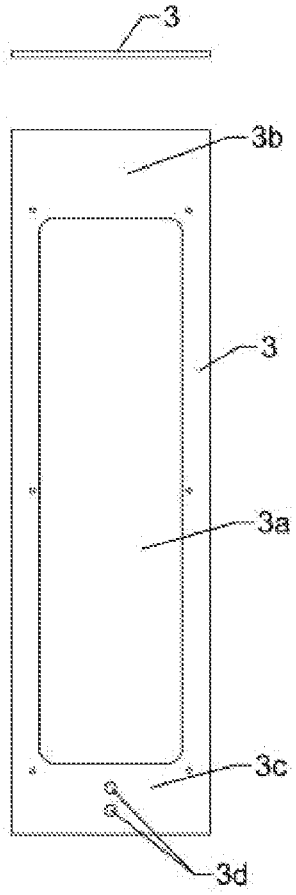

[Fig. 10B]
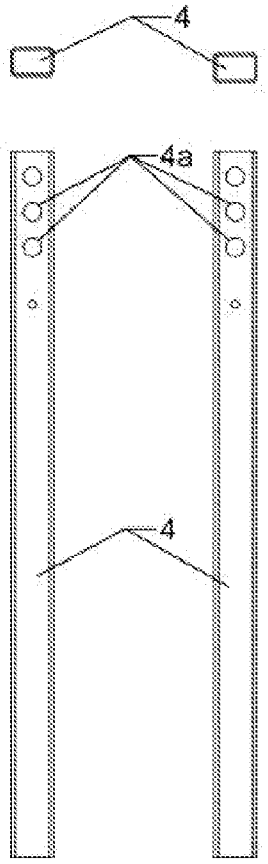
[Fig. 10C]
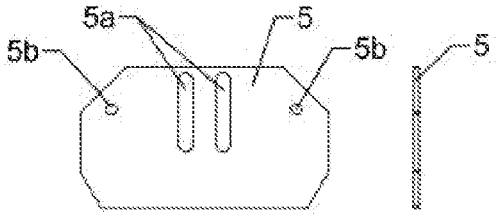
[Fig. 10D]
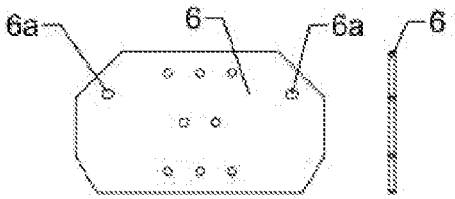

[Fig. 11]
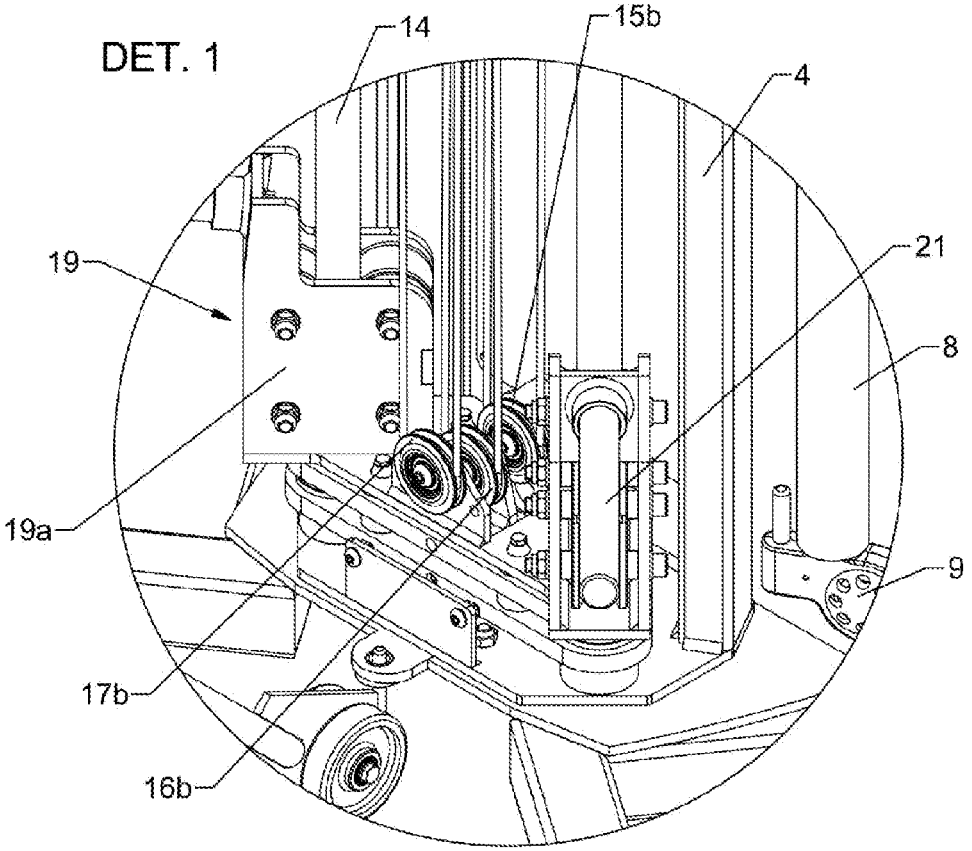
[Fig. 12]
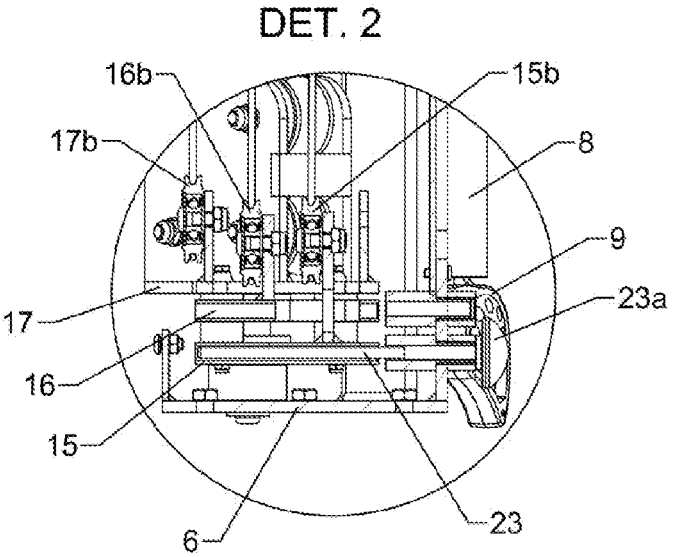

[Fig. 13]
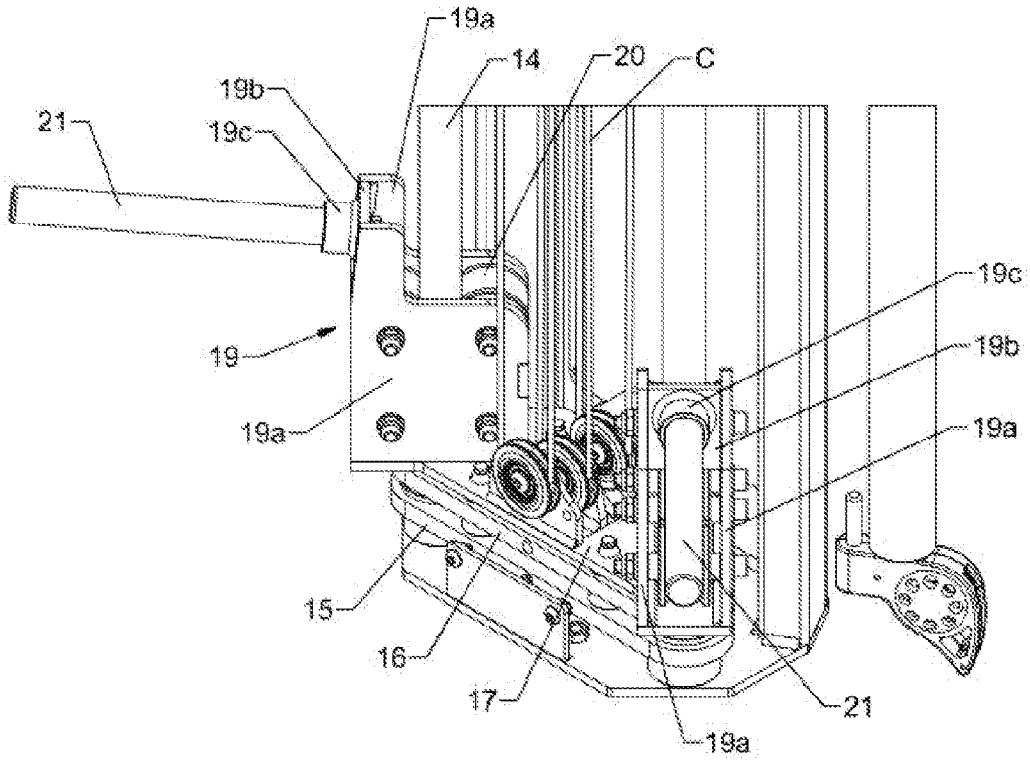

[Fig. 14]
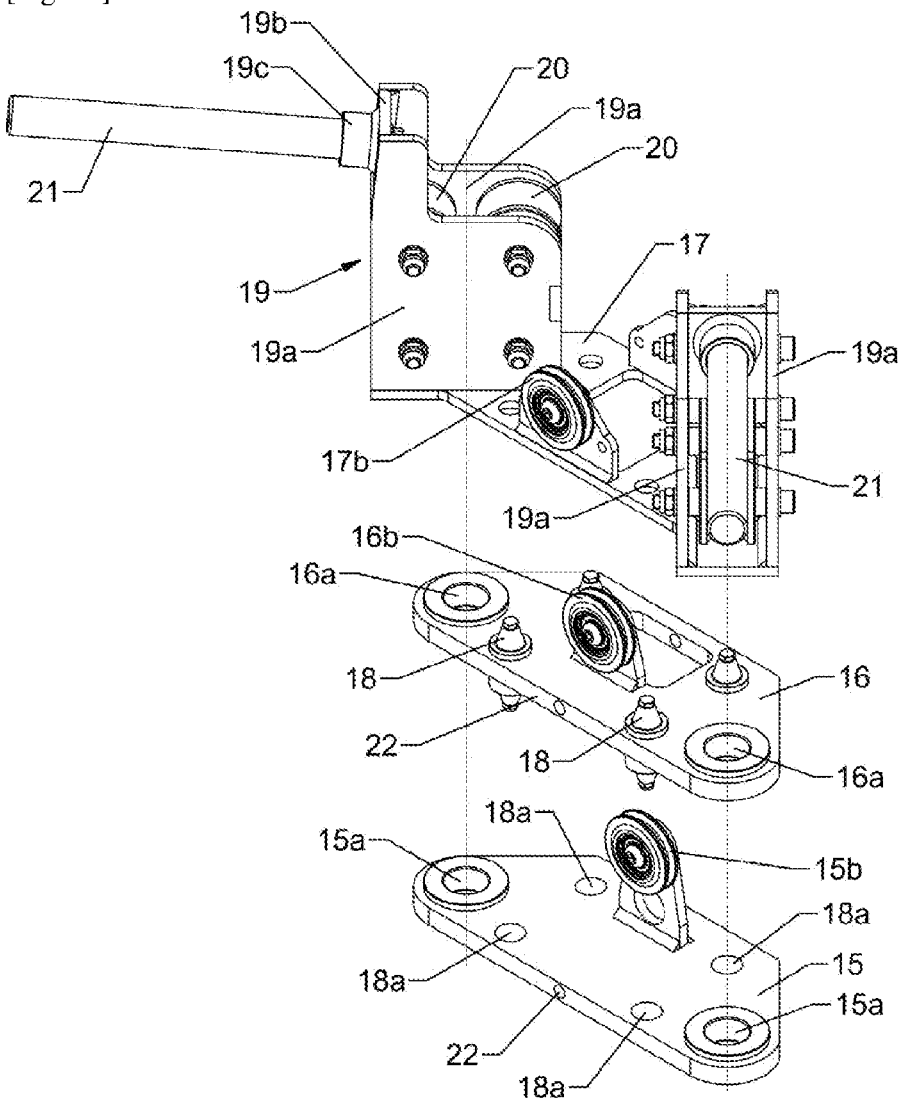

[Fig. 15]
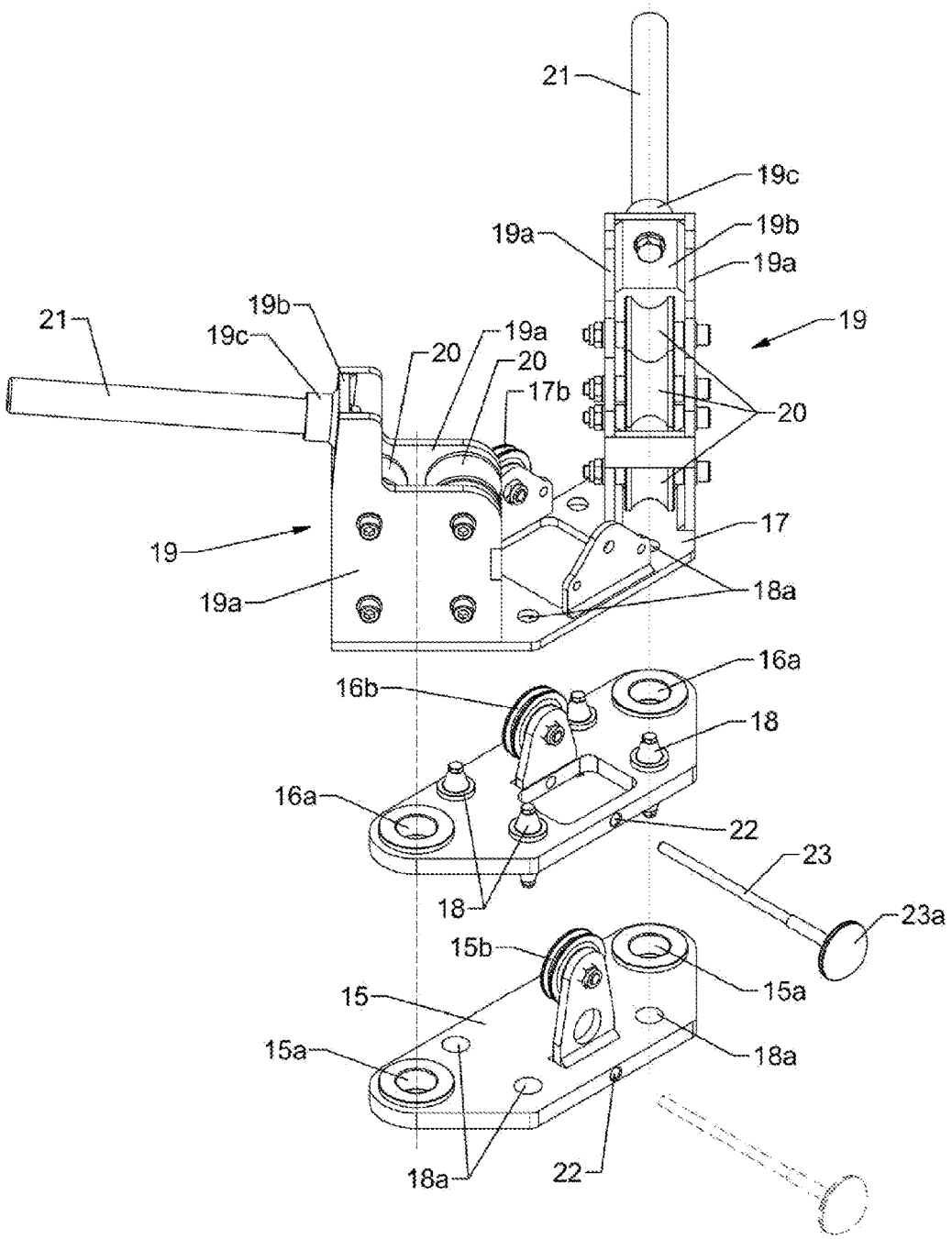
[Fig. 16]
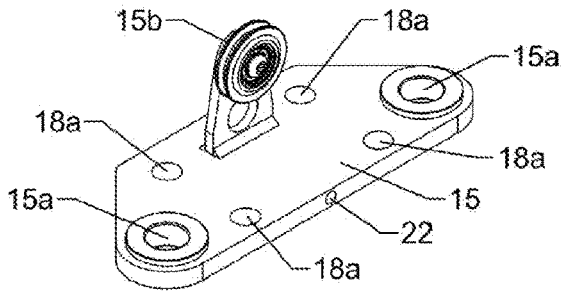

[Fig. 16A]
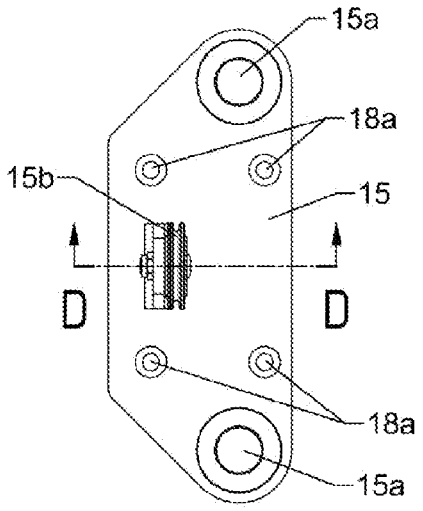
[Fig. 16B]
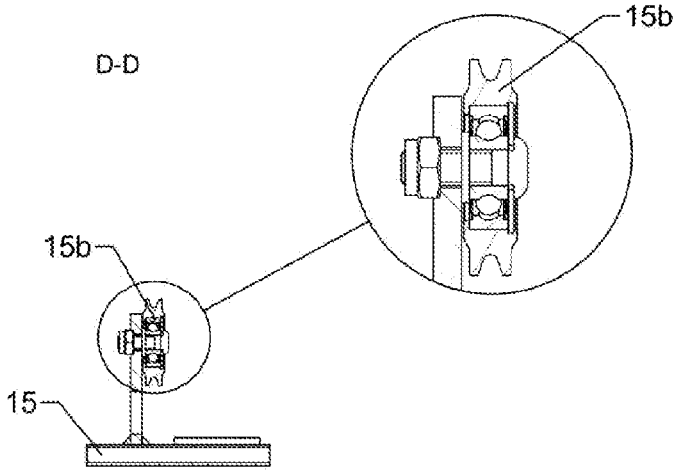
[Fig. 17]
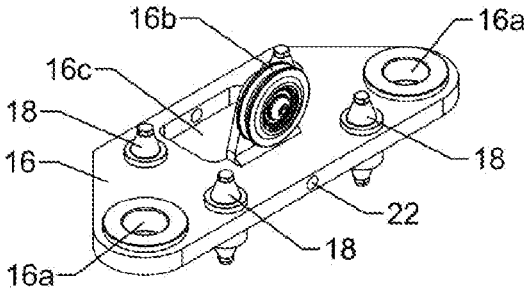

[Fig. 17A]
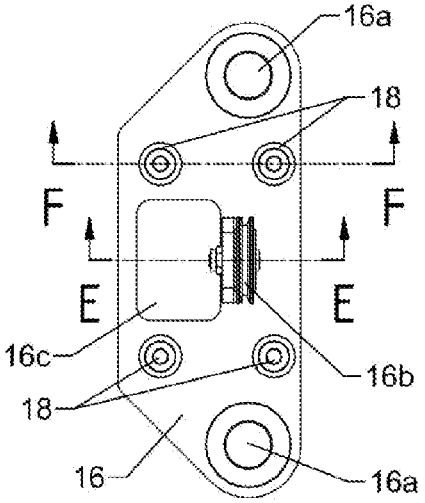
[Fig. 17B]
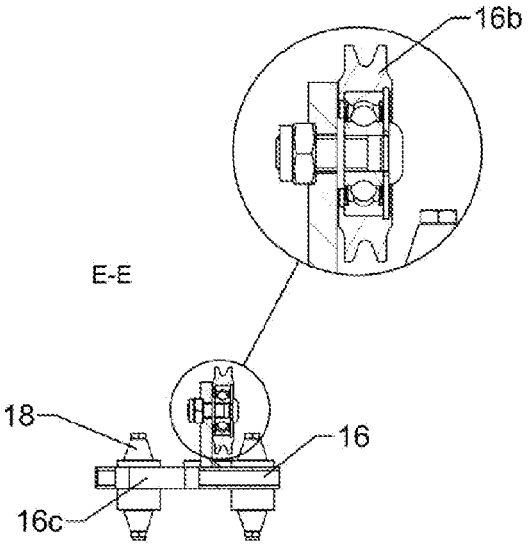

[Fig. 17C]
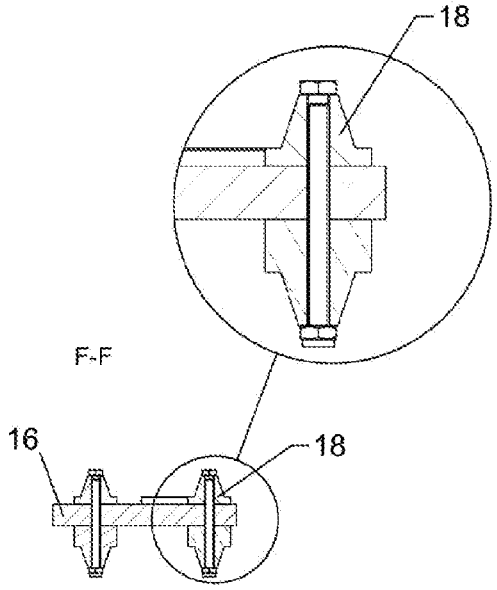
[Fig. 18]
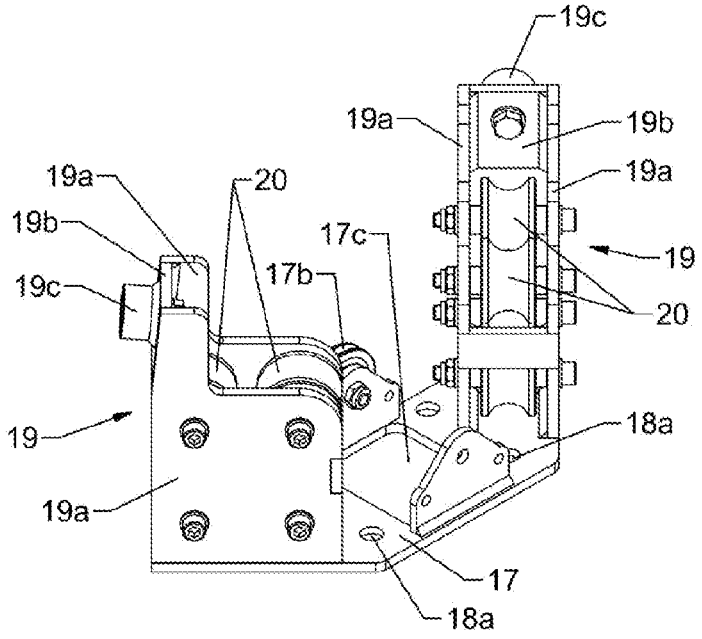

[Fig. 18A]
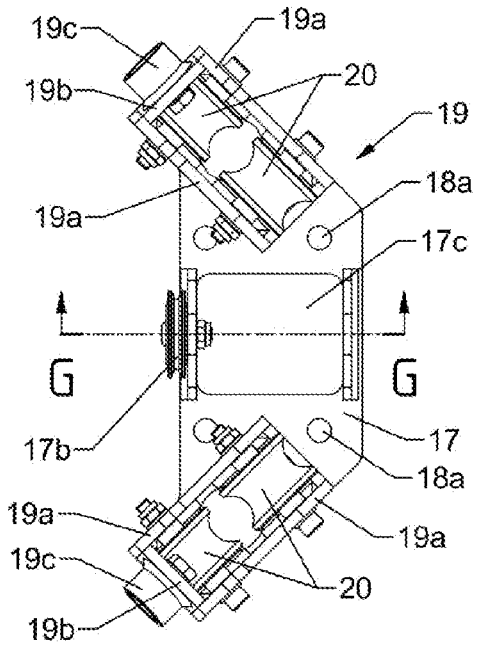
[Fig. 18B]
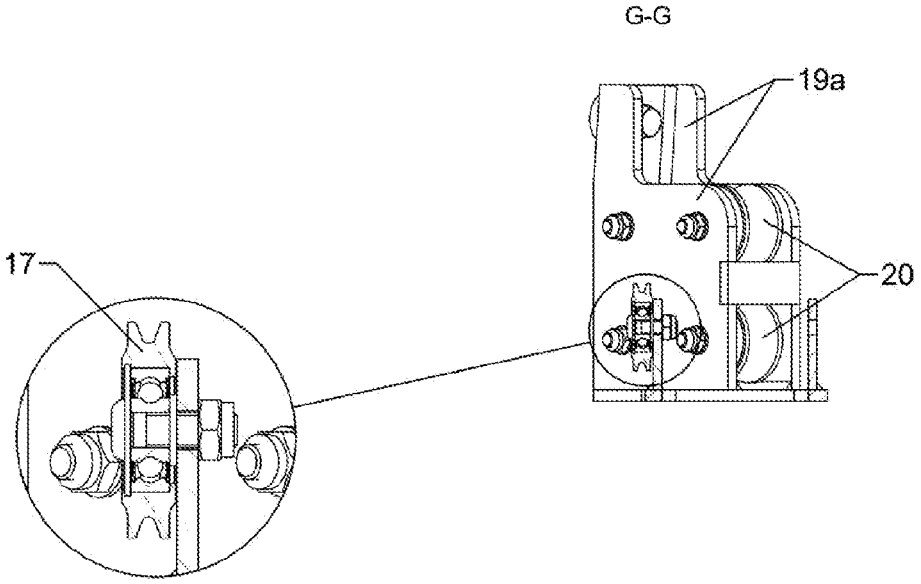

[Fig. 19]
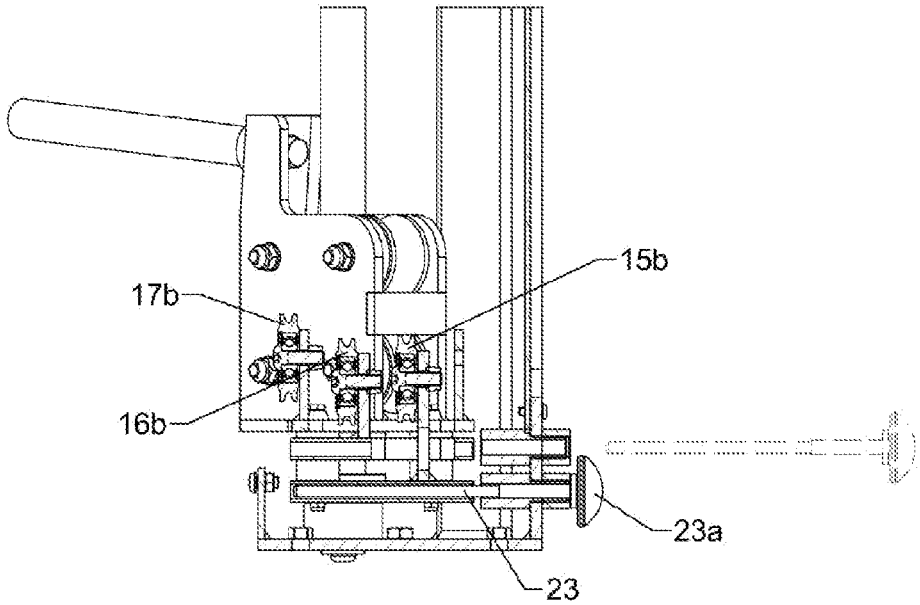
[Fig. 20]
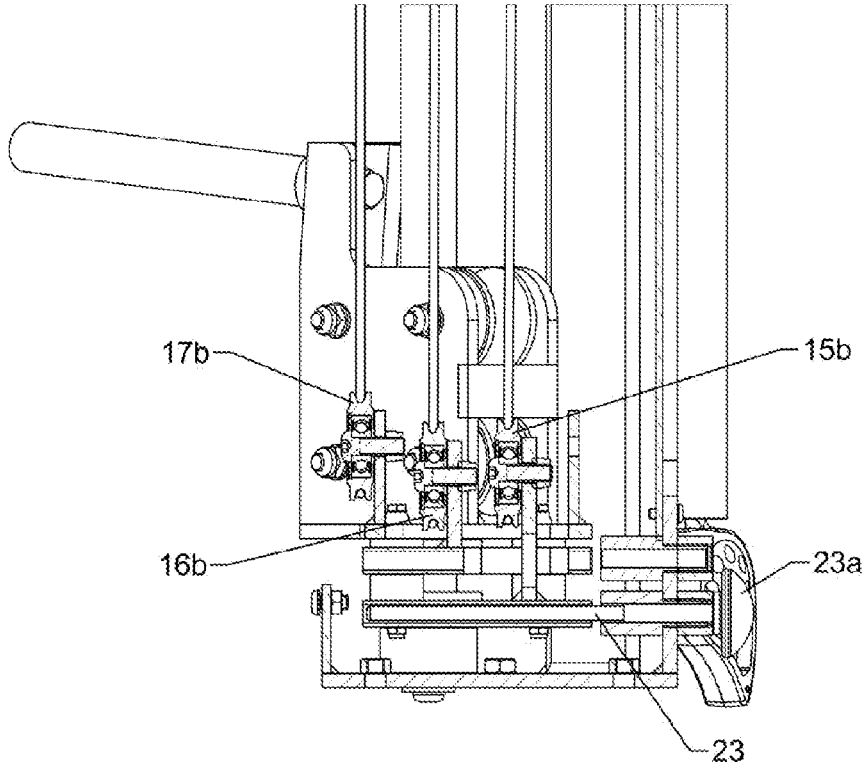

[Fig. 21]
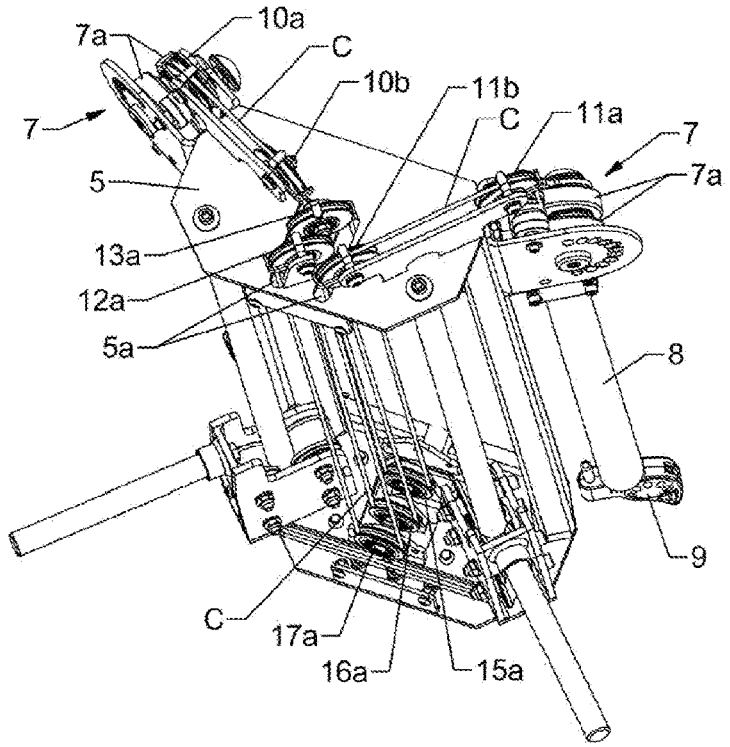
[Fig. 22]
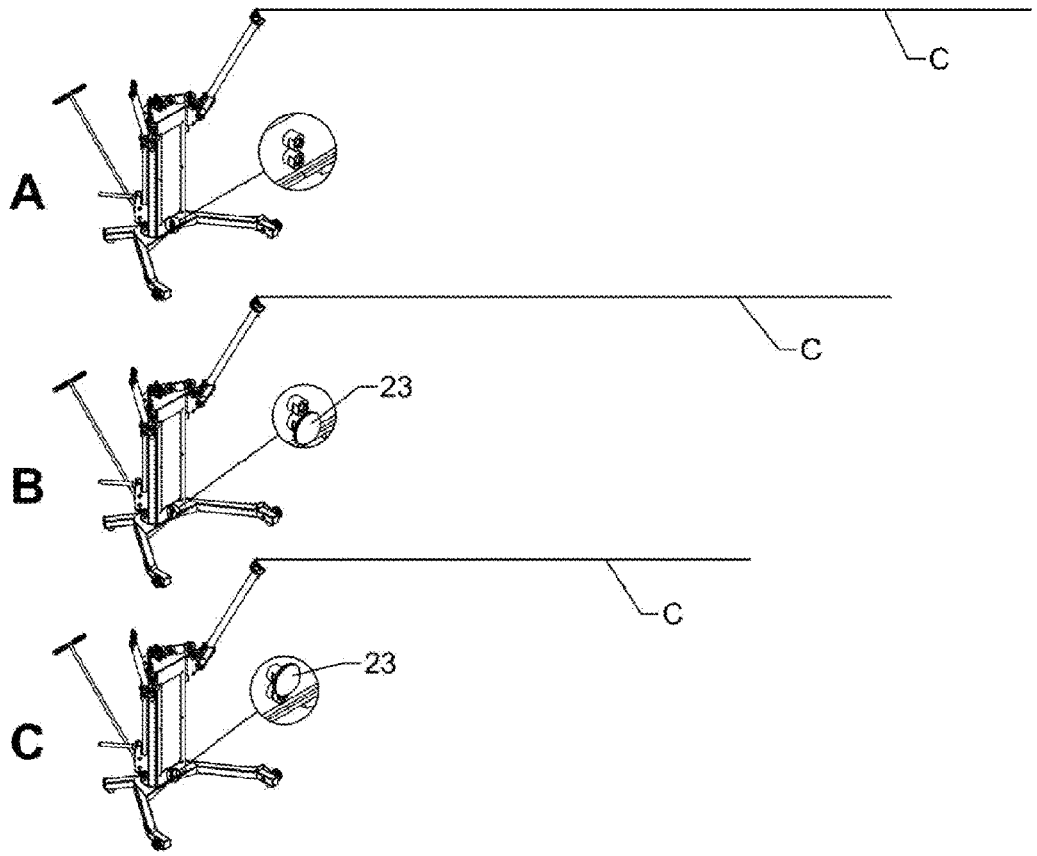

APPARATUS FOR THE PRACTICE OF PHYSICAL EXERCISES WITH A CABLE STRETCH VARIATION SYSTEM

TECHNICAL FIELD

This Invention Patent refers to an apparatus for the practice of physical exercises which is provided with a cable stretch variation system that allows user to adjust the cable pulling/pushing/stretching ratios, and, thus, perform a greater variety of exercises on a single machine.

DESCRIPTION OF THE STATE OF THE ART

As known in the art, exercise machines allow user to select the number of weights to be lifted during exercise. Using a handle, user pulls the machine steel cable, and thus, the chosen weight(s), performing the exercise at the desired intensity (determined by the number of weights) and the desired number of repetitions.

It is also known that the steel cable in this type of equipment has one of its ends (the one external to the machine) securely attached to the aforementioned handle manipulated by user during exercise. Meanwhile, its opposite end (inside the machine), after passing through various sets of pulleys, both fixed and movable, is securely attached to the first weight in a weight stack located within the machine structure.

Thus, when user pulls the handle, the attached cable is also pulled, causing the weight or weights inside the structure (previously selected by user) to go up, starting the exercise in successive ascents and descents.

Applicant is the holder of the patent application PCT/BR2018/050446, filed on Dec. 3, 2018 and published on Jun. 11, 2020 (WO 2020/113290) regarding an "EQUIPMENT WITH SETS OF TRIPLE PULLEYS AND SYSTEM FOR THREADING A LONG STEEL CABLE FOR IMPROVING PHYSICAL AND THERAPEUTIC EXERCISES".

This machine aims to address certain drawbacks of conventional equipment. Indeed, the issue with conventional equipment is the length of the steel cable, which does not allow user to create much distance from the machine during exercise. As a result, user can only perform exercises that do not require very wide movements, thereby limiting the range of possible exercises on a single equipment. Another issue is the bigger effort required from user to begin each exercise (initial movement).

To address these inconveniences, the mentioned previous application filed by the same Applicant (WO 2020/0113290) provides for a new triple pulley system that enables the installation of a longer cable along a greater number of pulleys and respective bearings installed in the machine. As a result, when pulled, the longer steel cable allows for greater distance between user and the machine, enabling the performance of exercises that require broader movements. On the other hand, with this new triple pulley system, the inertia force is minimized, requiring less effort from user to begin each exercise.

Another machine known from the prior art is described and illustrated in the patent application PCT/US2017/060845, filed on Nov. 9, 2017 and published on May 17, 2018 (WO 2018/089624), related to a "WEIGHT RATIO ARRANGEMENT FOR A WEIGHT MACHINE".

Such application proposes the creation of a conversion system that allows user to vary weight ratios (proportions between load and travel) during exercise on the same equipment. Indeed, as known, some physical exercises need short travel and a heavy load, while other exercises need long travel and a light load. A conversion mechanism allows both types of exercises to be performed on the same machine.

Therefore, according to the aforementioned patent application (WO 2018/089624), the referred conversion system comprises two sets of movable pulleys associated with a locking mechanism. The first movable pulley set, located at the top, is operatively attached to both the exercise cable (connected to the handle that is pulled by user) and the weight stack cable (connected to the first weight in the weight stack to be lifted). The second movable pulley set, located at the bottom, is only attached to the exercise cable (connected to the handle that is pulled by user).

The locking mechanism includes a latching lever that can be rotated between a locked position and an unlocked position. It is provided with two apertures into which the handle can be inserted. Such handle is equipped with a spring and is operated by user. When this handle is placed in line with either of these two apertures, it holds the latching lever either in the locked position (preventing the movement of the bottom movable pulley set) or in the unlocked position (allowing the movement of the bottom movable pulley set).

So, in a brief and summarized description, when the locking mechanism is in the first position (locked), the bottom movable pulley set cannot move. Therefore, when user pulls the exercise cable through the handle, only the top movable pulley set moves, and, as a result, the associated weight stack is lifted. This position determines the first weight ratio for exercises.

On the other hand, when the locking mechanism is in the second position (unlocked), the bottom movable pulley set can be moved. Consequently, when user pulls the exercise cable through the handle, both the top and bottom movable pulley sets move, and, as a result, the associated weight stack is lifted according to a weight ratio different than before. This position determines the second weight ratio for exercises.

It is important to note that, in order to switch between these two positions, "locked" and "unlocked", user needs to use the handle located on the side of the machine. In the locked position, such handle is in line with one of the apertures of the latching lever and remains in that position because of the spring. To change positions, user needs to pull such handle, removing it from the aperture of the latching lever it was in, overcoming the action of the spring holding it in that aperture. Once the latching lever handle is pulled out, user can then rotate the lever, moving it until the handle is aligned with the other aperture. At this point, user releases the handle, and, because of the spring, the handle goes into the mentioned aperture, setting the lever to the unlocked position.

DRAWBACKS OF THE STATE OF THE ART

Although the machine described in document WO 2018/089624 operates satisfactorily, the conversion system therein provided to enable the adjustment of weight ratios during exercise seems be very complex from a structural point of view.

In fact, such a conversion system involves two sets of movable pulleys, each composed of the respective pulleys, and a locking mechanism consisting of a reasonable number of components (lever, handle, spring, etc.).

Clearly, the assembly of these components requires specialized labor and constant maintenance services, which reflects in the final cost of the equipment.

On the other hand, as previously described, changing the positions from "locked" to "unlocked", and vice versa, requires a specific sequence of procedures on the handle and the latching lever, which, in turn, requires prior knowledge and some skill by user.

BRIEF DESCRIPTION OF INVENTION

In order to address these drawbacks, Applicant has conceived a new exercise machine, which is provided with an innovative cable stretch variation system, capable of allowing the adjustment of the pull/traction ratio of the load based on the cable's length, a feature that was not provided in previous systems, including the system described and illustrated in the aforementioned prior document WO 2018/089624. Besides, the construction and the operation of this new system are entirely different from all systems known in the art.

According to this patent application, the hereby proposed variation system includes three horizontal and parallel platforms, arranged one above the other, each platform having a single and respective pulley. The single and continuous cable of the machine goes through these three pulleys. The top platform is attached to two mobile carriages, provided with pairs of rollers capable of sliding up and down along two vertical columns when user pulls the exercise cable. Each mobile carriage has slightly inclined bars along which user can secure the desired weights (discs) for each exercise. The other two platforms (intermediate and bottom ones) have a hole for user to insert a selector pin through the front of the machine.

Thus, during the use of the equipment, if user wishes to do very light exercises, after selecting the appropriate weights (discs) and securing them to the two inclined bars of the top mobile carriage, user simply does not insert the selector pin into the hole of either of the mentioned platforms (intermediate and bottom). This way, when user pulls the exercise cable through the handle, all three platforms move (they are lifted) by the continuous cable passing through their respective pulleys, resulting in a longer stretching length, which corresponds to using the machine in a 6×1 ratio (less weight and more cable extension).

If user wishes to perform slightly heavier exercises, similarly, after selecting the appropriate weights (discs) and securing them to the two inclined bars of the top mobile carriage, user shall insert the selector pin into the hole of the bottom platform. This way, when user pulls the exercise cable through the handle, the bottom platform remains locked (it does not move), and only the other two platforms (intermediate and top) move (they are lifted) by the continuous cable passing through their respective pulleys, resulting in a slightly shorter stretching length, which corresponds to using the machine in a 4×1 ratio (a bit more weight and slightly less cable extension).

Yet, if user wishes to do much heavier exercises, again, after selecting the appropriate weights (discs) and securing them to the two inclined bars of the top mobile carriage, user shall insert the selector pin into the hole of the intermediate platform. This way, when user pulls the exercise cable through the handle, both the intermediate and lower platforms remain locked (they do not move), and only the upper platform moves (it is lifted) by the continuous cable passing through its respective pulley, resulting in a much shorter stretching length, corresponding to using the machine in a 2×1 ratio (more weight and less cable extension).

As it can be seen, the construction of the variation system of the equipment at stake is entirely new and different, but substantially simpler. Besides, it can be easily and quickly assembled, and it does not require usual and frequent maintenance services, all of which reflect in a lower equipment cost.

On the other hand, user can choose the desired position (using the machine in a 6×1 ratio, a 4×1 ratio or a 2×1 ratio) in an extremely simple and fast way by either inserting or not inserting the selector pin into the hole of the bottom or intermediate platform, which does not require any effort, prior knowledge or skill, as in the previously known machine.

This will be explained in detail throughout this report with the assistance of the attached drawings.

DESCRIPTION OF DRAWINGS

For illustration and a perfect visualization of the new physical exercise machine, the object of this patent, the following drawings are submitted:

FIG. 1 is a front perspective view of the hereby innovated machine, optionally equipped with a bottom transportation base. The enlarged detail view above shows one of the pieces-bearings for pulleys provided on its top surface.

FIG. 2 is a rear perspective view of said machine. The enlarged detail view above now shows the other two pieces-bearings for pulleys provided on its top surface.

FIGS. 3 to 9 illustrate, one after the other, various views and cross-sections of the machine illustrated in FIGS. 1 and 2, now without the optional bottom transportation base, namely:

FIG. 3 is the front perspective view of the machine;

FIGS. 4 and 5 are cross-sectional views of the machine, respectively along the lines A-A and B-B indicated in FIG. 3;

FIG. 6 is a top view of the machine at stake;

FIGS. 7 and 8 are the side and rear views of said machine, respectively; and FIG. 9 is another cross-sectional view of said machine, according to the line C-C indicated in FIG. 8;

FIG. 10 illustrates each of the elements that are part of the main structure of the hereby innovated machine, namely:

FIG. 10A shows the top and front views of the front plate;

FIG. 10B shows the top and front views of the two side columns;

FIG. 10C shows the top and side views of the top plate; and

FIG. 10D shows the top and side views of the bottom plate;

FIGS. 11 and 12 are enlarged detail views of the bottom part of the machine, respectively indicated as DET. 1 in FIG. 2 and DET. 2 in FIG. 4. These details illustrate the hereby innovated cable stretch variation system, formed by three horizontal and parallel platforms, one above the other, each equipped with a respective pulley;

FIG. 13 is another enlarged detail view of the bottom part of the machine, similar to the detail illustrated in FIG. 11;

FIG. 14 is a rear exploded perspective view of the three platforms that form the hereby innovated cable stretch variation system;

FIG. 15 is a front exploded perspective view of the same three platforms, also illustrating the selector pin that is part of the hereby innovated variation system;

FIG. 16 is a perspective view of the first platform (the bottom one), equipped with its respective pulley;

FIG. 16A shows a top view of said bottom platform;

FIG. 16B is a sectional view of said bottom platform, according to the line D-D indicated in FIG. 16A. Alongside there is an enlarged detail view of its respective pulley;

FIG. 17 is a perspective view of the second platform (the intermediate one), equipped with its respective pulley;

FIG. 17A shows a top view of said intermediate platform;

FIG. 17B is a cross-sectional view of said intermediate platform, according to the line E-E indicated in FIG. 17A. Alongside there is an enlarged detail view of its respective pulley;

FIG. 17C is a cross-sectional view of said intermediate platform, according to the line F-F indicated in FIG. 17A. Alongside there is an enlarged detail view of the guide bushings provided therein;

FIG. 18 is a perspective view of the third platform (the top one), to which the two movable carriages are fixed;

FIG. 18A shows a top view of said top platform;

FIG. 18B is a cross-sectional view of said top platform, according to the line G-G indicated in FIG. 18A. Alongside there is an enlarged detail view of its respective pulley;

FIGS. 19 and 20 are enlarged detail views of the bottom part of the machine, similar to FIG. 12, illustrating the possibility of inserting the selector pin into either the bottom or intermediate platforms, through the front of the machine. This pin is also part of the hereby innovated variation system;

FIG. 21 is a rear perspective view of the machine, seen from above, showing the path of the steel cable from its anchoring points, passing through the six top pulleys and the three bottom pulleys (each of the latter ones fixed to each of the hereby innovated platforms);

Finally, FIG. 22 is a schematic illustration showing the cable stretching lengths—long, slightly shorter and much shorter—corresponding to the use of the machine in the 6×1 (less weight and more cable extension), 4×1 (a little more weight and a little less cable extension) and 2×1 (more weight and less cable extension) ratios.

DETAILED DESCRIPTION OF INVENTION

The object of this Invention patent is an "APPARATUS FOR THE PRACTICE OF PHYSICAL EXERCISES WITH A CABLE STRETCH VARIATION SYSTEM", a machine (1) that can be available with or without an optional mobile transportation base (2). In the perspective views of FIGS. 1 and 2, the machine (1) is illustrated with the mentioned mobile transportation base (2), while in the views and cross-sections of FIGS. 3 to 9, the machine is illustrated without the mentioned mobile base (2).

The mobile transportation base (2) is of a type already known in the prior art. Such base (2) is formed by two pairs of horizontal crossbars (2*a*)/(2*b*), arranged in an "L" shape, topped by a central horizontal plate (2*c*) on which the machine (1) is mounted (in the version with a mobile transportation base). The crossbars (2*b*) are provided with an upwardly inclined short front section (2*d*) on which the respective wheels (2*e*) for moving the machine are mounted, along with a central double rear wheel (2*f*) conveniently mounted on the central plate (2*c*), from which starts an inclined rear bar (2*g*) with a handle (2*h*) at its free end, which allows the mobile transportation base (2) to be moved from one location to another, as desired by user. At the free ends of the crossbars (2*a*) and (2*d*), bottom support feet (2*i*) are provided to keep the assembly properly grounded.

The machine (1) consists of a main structure formed by a basically rectangular front vertical plate (3), two quadrangular vertical side columns (4), and two horizontal plates, one on top (5) and one at the bottom (6), both of a basically octagonal shape, with two larger sides and six smaller sides, the two larger sides forming the front and rear edges of the structure, and the six smaller sides, three on each side, delimiting the lateral edges of the structure. These components are illustrated separately in FIG. 10.

Although the plates and columns that form the main structure of the machine (1) have been described and illustrated hereto with certain shapes and characteristics, said structure can obviously be formed by components that have different shapes and characteristics without changing the main scope of the present invention.

Continuing the description of the main structure of the machine (1), the front vertical plate (3) is provided with a large rectangular window (3*a*), above and below which two respective panels (3*b*) and (3*c*) are delimited. In the bottom panel (3*c*), two circular apertures (3*d*) are provided, vertically aligned and arranged at different levels, one slightly lower than the other, into which a selector pin, which will be described below, can be inserted.

Both vertical side columns (4) are provided with perforations (4*a*), in which respective sets of pulleys (7) are properly mounted. A single continuous steel cable, generically indicated in the drawings by the letter "C", passes through these pulleys (7*a*). Such pulley sets (7) are interconnected with respective articulated arms (8) through which the mentioned cable "C" passes, and whose opposite end is also interconnected, in an articulable way, to a respective terminal (9), to which each of the cable ends is anchored. The accessories (handles or others) through which user pulls the cable are inserted in the mentioned terminals (9).

When the machine (1) is provided with the mobile transportation base (2), the lower plate (6) of its structure is properly fixed to the central horizontal plate (2*c*) of said base (2), as shown in the perspective views of FIGS. 1 and 2. When the machine is provided without said mobile transportation base (2), the lower plate (6) of its structure rests on the ground, as illustrated in the views and cross-sections of FIGS. 3 to 9.

Conveniently fixed on the top external face of the top horizontal plate (5) are four vertical pieces (10), (11), (12) and (13) that serve as bearings for the installation of the respective pulleys.

Thus, two larger pieces-bearings (10) and (11), basically rectangularly shaped, are obliquely arranged in relation to the vertical median plane of the structure, from the front corners of the plate (5), where the pulley sets (7) are located, towards its rear edge, and are mounted with two respective pulleys (10*a*)/(10*b*) and (11*a*)/(11*b*). Piece (10) is shown in enlarged details above FIG. 1, and piece (11) is shown in enlarged details above FIG. 2.

The other two smaller pieces-bearings (12) and (13), basically triangularly shaped, are arranged in the rear median region of the plate (5), parallel to piece (11), one of them (12) is shown in enlarged details also above FIG. 2. On each of the pieces-bearings (12) and (13), the respective pulleys (12*a*) and (13*a*) are properly mounted. The steel cable "C" of the machine, whose ends are anchored in the terminals (9) to be pulled by user, after passing through the pulleys (7*a*) of the pulley sets (7), passes through all these pulleys (10*a*), (10*b*), (11*a*), (11*b*), (12*a*) and (13*a*), as will be described below.

Also, on the top horizontal plate (5), coinciding with the mentioned pieces-bearings (12) and (13), two slots (5*a*) are provided, parallel to each other, for cable "C" to pass in its path along all these pulleys. And two circular apertures (5*b*), spaced apart, are also provided. To each of them, the top end of two respective vertical columns (14) is fixed. These vertical columns (14) are cylindrical and tubular, and the respective mobile carriages slide vertically along them (described later).

The bottom horizontal plate (6) also has two circular apertures (6*a*), aligned with the apertures (5*b*) of the top plate (5), to each of which the lower end of the two aforementioned cylindrical and tubular vertical columns (14) is fixed. The respective mobile carriages of the pulley slide vertically along them (described later).

On the top inner face of the mentioned bottom horizontal plate (6), the components of the cable stretch variation system, which is illustrated in more detail from FIG. 11 on and will be described below, are mounted.

According to the present invention, the machine for physical exercise (1) described above is equipped with an innovative cable stretch variation system, which comprises the provision of three horizontal and parallel platforms, the bottom (15), the intermediate (16) and the top (17), arranged one above the other. These platforms are located at the bottom of the machine (1), over the bottom plate (6), in the space delimited by the front plate (3) and the side columns (4). These platforms (15), (16) and (17) can move vertically, together or independently when pulled by the machine steel cable, as will be explained in more detail below.

Preferably, the bottom (15) and intermediate (16) platforms have a basically trapezoidal shape, while the top platform (17) has a stylized "V" shape, as better illustrated in the exploded perspectives of FIGS. 14 and 15 and in the details of FIGS. 16, 17 and 18. These platforms may obviously have other shapes as long as they are compatible with the internal space delimited by the machine structure.

Each of the three platforms (15), (16), and (17) is provided with two distal circular apertures (16*a*), (17*a*) and (18*a*), vertically aligned, through which the two vertical columns (14) already mentioned pass.

Each of the three platforms (15), (16) and (17) is also provided with a respective pulley (15*b*), (16*b*) and (17*b*) in its median region. These pulleys are arranged parallel to the longitudinal axis of the platforms.

The pulley (15*b*) of the bottom platform (15) passes through an aperture (16*c*) provided in the intermediate platform (16), while the pulleys (15*b*) and (16*b*) of the bottom (15) and intermediate (16) platforms pass through an aperture (17*c*) provided in the top platform (17), so that, when such platforms (15), (16) and (17) are stacked on top of each other, their pulleys (15*b*), (16*b*) and (17*b*) get to be parallel and close to each other, as better illustrated in FIGS. 11, 12, and 13. When the platforms (15), (16) and (17) are pulled by the steel cable "C", these apertures allow the vertical movement of the three platforms together, or only two, or even just one, depending on the ratio chosen by user, as will be explained in more detail below.

To keep the three platforms (15), (16) and (17) perfectly aligned and properly supported on top of each other after their vertical movement, the intermediate platform (16) is equipped with four guide bushings (18), as detailed in FIG. 17C. The bottom and top ends of these guide bushings (18) coincide with corresponding circular apertures (18*a*) provided both in the bottom platform (15) and the top platform (17) (see FIGS. 16, 17 and 18). When the platforms are stacked on top of each other, after moving vertically, these guide bushings (18) guide their positioning and absorb the impact between them.

Referring again to the exploded perspective views of FIGS. 14 and 15 and to the details in FIG. 18, it can be seen that, on the top platform (17), coinciding with its circular apertures (17*a*) through which the vertical columns (14) pass, two respective mobile carriages (19) are mounted. Each carriage is formed by a pair of vertical plates (19*a*) with a stylized "L" shape, between which four small rollers (20) are properly mounted, arranged two by two. These rollers (20) can slide vertically up and down the vertical columns (14) when the mobile carriages (19) are pulled by user through the exercise cable handle, as will be explained below.

The vertical plates (19*a*) of each mobile carriage (19) are interconnected on one side by a respective small plate (19*b*) provided with a corresponding small tube (19*c*) to which a corresponding circular section bar (21) is introduced. This bar is slightly inclined and the weights desired by user for performing each exercise can be inserted along it. More specifically, these weights are in the form of disks, whose central hole fits onto the mentioned bar (21) provided in each of the mobile carriages (19). Therefore, the mobile carriages (19) are the elements carrying the weights to be lifted by user during each exercise.

Finally, using more specifically the exploded perspective view of FIG. 15, the bottom (15) and intermediate (16) platforms are provided with a respective through-hole (22) for the insertion of a locking selector pin (23) equipped with a front handle (23*a*) through the front of the machine. This selector pin (23) is also part of the hereby innovated cable stretch variation system.

It has already been mentioned above that, in the bottom panel (3*c*) of the front plate (3) of the machine (1), two circular apertures (3*d*) are provided. These two circular apertures (3*d*) are vertically aligned and arranged at different levels, one slightly below the other. The mentioned through-hole (22) provided in each of the bottom (15) and intermediate (16) platforms coincides precisely with these circular apertures (3*d*) in the front plate (3). The mentioned selector pin (23) can be inserted into said apertures (3*d*) and holes (22) by user, depending on the type of exercise to be performed on the machine (see FIGS. 19 and 20).

In fact, such selector pin (23) is the element through which user determines the cable stretch positions they want, which correspond to the use of the machine in the 2×1, 4×1 or 6×1 ratios. This will be explained in more detail below.

Having described all components of the machine (1), as well as all components of the hereby innovated cable stretch variation system, we proceed to describe the operation of the machine.

Initially, we use FIG. 21 to illustrate the path of the steel cable "C" along the pulleys of the machine (1). As can be seen in this figure, which illustrates the machine from a perspective view, looking from above and from the rear, one end of the steel cable "C" is anchored at one of the terminals (9), from which the cable can be pulled by user using a handle or other appropriate accessory attached to it (not shown). From there, cable "C" passes through the interior of the arm (8) associated with that terminal (9), reaches the corresponding pulley set (7), and then passes through the pulleys (7*a*) provided therein.

After exiting the pulley set (7), cable "C" passes through the top pulleys (11*a*) and (11*b*) of the machine and enters it through the first slot (5*a*) provided in its top plate (5), heading down until it reaches the bottom pulley (17*b*)

attached to the top platform (17), where the mobile carriages carrying the weights (19) are mounted. From the pulley (17*b*), the steel cable "C" goes up, exiting the machine through the second slot (5*a*) of its top plate (5). Passing through the top pulley (12*a*), it re-enters the machine through the first slot (5*a*), going down until it reaches the bottom pulley (16*b*) attached to the intermediate platform (16). From the pulley (16*b*), the steel cable "C" goes back up, again exiting the machine through the second slot (5*a*), and passing through the top pulley (13*a*). Then it re-enters the machine through the first slot, heading down until it reaches the bottom pulley (15*b*) attached to the bottom platform (15). From the pulley (15*b*), the steel cable "C" goes up once again, exiting the machine through the second slot (5*a*) and passing through the top pulleys (10*a*) and (10*b*).

From there, cable "C" enters the other pulley set (7) of the machine, passing through the pulleys (7*a*) provided therein, goes through the other arm (8) corresponding to it, and reaches the other terminal (9), where the other end of the cable is anchored [this other arm (8) and this other terminal (9) are not visible in FIG. 21]. From this other terminal (9), the cable can also be pulled by user using a handle or other suitable accessory attached to it (not shown).

Thus, depending on the type of exercise to be performed on the machine, user can pull one end of cable "C" using a handle (or another accessory) associated with only one of the terminals (9), or pull both ends of cable "C" simultaneously, using handles (or other accessories) associated with both terminals (9).

Depending on the load desired by user, they can choose the appropriate weights (discs) and insert them in the inclined bars (21) of both mobile carriages (19) mounted on the top platform (17).

During the use of the machine, if user wishes to perform very light exercises, they simply do not insert the selector pin (23) into any of the bottom (15) and intermediate (16) platforms. In this option—without the pin (23)—the three platforms (15), (16) and (17) may be lifted by cable "C" when user pulls it through the handle interconnected to one or both terminals (9). This way, the three platforms (15), (16) and (17) will move (will be lifted) together, and consequently, the stretching length will be longer, corresponding to the use of the machine in the 6×1 ratio (less weight and more cable extension)—see Scenario "A" in the schematic illustration in FIG. 22.

If user wishes to perform slightly heavier exercises, they shall insert the selector pin (23) into the hole (22) of the bottom platform (15), which will keep it secured to the machine and, therefore, prevent it from being lifted. In this option—with the pin (23) in the bottom platform (15)—only two platforms, the top (17) and the intermediate (16) ones, may be lifted by cable "C" when user pulls it through the handle connected to one or both terminals (9). This way, both platforms (16) and (17) will move (will be lifted), and consequently, the stretching length will be slightly shorter, corresponding to the use of the machine in the 4×1 ratio (a bit more weight and a bit less cable extension)—see Scenario "B" in the schematic illustration in FIG. 22.

If user wishes to perform much heavier exercises, they shall insert the selector pin (23) into the hole (22) of the intermediate platform (16). This will keep both the intermediate platform (16) and the bottom platform (15) secured to the machine, and therefore, it will not be possible to lift them. In this option—with the pin (23) in the intermediate platform (16)—only the top platform (17) can be lifted by cable "C" when user pulls it through the handle connected to one or both terminals (9). This way, only the top platform (17) will move (will be lifted), and the stretching length will be much shorter, corresponding to the use of the machine in the 2×1 ratio (more weight and less cable extension)—see Scenario "C" in the schematic illustration in FIG. 22.

Please note that when the bottom platform (15) is secured, the successive up and down movements of the intermediate (16) and top (17) platforms are possible thanks to the apertures (16*c*) and (17*c*) provided therein, through which the pulley (15*b*) of the bottom platform (15) passes. Similarly, when the bottom (15) and intermediate (16) platforms are secured, the successive up and down movements of the top platform (17) are possible thanks to the aperture (17*c*) provided therein, through which the pulleys (15*b*) and (16*b*) of the bottom (15) and intermediate (16) platforms pass, respectively.

Please also note that, during the successive up and down movements of the platforms (15)/(16)/(17)—whether of the three platforms together, of the top (17) and intermediate (16) platforms, or only the top (17) platform, depending on the ratio chosen by user—the mobile carriages (19) mounted on the top platform (17) slide up and down along the vertical columns (14) thanks to their rollers (20), which are in permanent contact with the surface of said columns.

As can be seen, the hereby proposed variation system is entirely innovative, as it allows varying the load pull/traction ratios depending on the cable length. Additionally, the construction and the operation of this new system are different and substantially simpler than known systems, as it includes the provision of the three horizontal and parallel platforms (15), (16) and (17) described above, arranged one above the other, with each platform having a single respective pulley (15*b*), (16*b*) and (17*b*), and two of them, the bottom (15) and the intermediate (16) ones, having a hole (22) for user to insert the selector pin (23) through the front of the machine, something that user can do extremely easily and quickly.

Although the preferred embodiment of the hereby innovated physical exercise machine, as well as of the hereby proposed new cable stretch variation system has been described and illustrated hereto, other embodiments are also considered, which, corresponding to the one described hereto, will also be protected by the scope of the present invention.

The invention claimed is:

1. An exercise apparatus comprising:

a front vertical plate;

a top horizontal plate, wherein the top horizontal plate is coupled to the front vertical plate;

a pair of vertical side columns, each side column coupled to one end of the front vertical plate, and wherein each side column has one or more perforations;

a pair of pulleys, wherein each pulley is mounted in the one or more perforations;

a pair of articulated arms, wherein a first end of each of the arms is interconnected with one of the pulleys, wherein an opposing end of each of the arms is interconnected to a terminal;

a single and continuous steel cable, wherein each of the arms is anchored to one end of the steel cable;

a bottom horizontal plate arranged at the base of the apparatus; and three horizontal and parallel platforms, comprising: a bottom platform, an intermediate platform and a top platform, wherein each of the platforms is arranged one above the other over the bottom horizontal plate in a space defined by the front vertical plate and the pair of side columns.

2. The exercise apparatus according to claim 1, further comprising a mobile transportation base.

3. The exercise apparatus according to claim 1, wherein the top horizontal plate further comprises four fixed vertical pieces and two slots for the steel cable to pass across the pair of pulleys.

4. The exercise apparatus according to claim 1, wherein the front vertical plate is provided with a rectangular window, wherein the window is defined above and below with respective top and bottom panels.

5. The exercise apparatus according to claim 1, wherein the bottom and intermediate platforms have a substantially trapezoidal shape, and wherein the top platform has a stylized "V" shape.

6. The exercise apparatus according to claim 1, wherein each of the platforms is vertically movable, and wherein each of the platforms has a corresponding one of the pair of pulleys in its median region.

7. The exercise apparatus according to claim 6, wherein the intermediate platform has guide bushings, bottom and top ends of which coincide with corresponding circular apertures provided in both the bottom platform and the top platform, and wherein the top platform coincides with the circular apertures traversed by the vertical columns.

8. The exercise apparatus according to claim 1, wherein two mobile carriages are mounted on the top platform, each mobile carriage formed by a pair of vertical plates between four mounted rollers arranged in pairs, wherein the rollers are configured to slide up and down along the pair of vertical side columns.

9. The exercise apparatus according to claim 8, wherein the vertical plates of each mobile carriage are interconnected by a respective plate having a corresponding tube, wherein the corresponding tube comprises an inclined corresponding circular section bar, and wherein the circular section bar is configured to receive one or more desired weights.

10. The exercise apparatus according to claim 9, wherein the one or more desired weights are configured as discs, and wherein a central hole of the discs is configured to fit onto the circular section bars.

11. The exercise apparatus according to claim 9, wherein the bottom and intermediate platforms have a respective through-hole to insert a locking selector pin.

12. The exercise apparatus according to claim 11, wherein the selector pin determines one or more cable stretch variation positions corresponding to a use of the machine in 2×1, 4×1, or 6×1 ratios.

13. The exercise apparatus according to claim 12, wherein vertical movement of the three platforms is dependent on the cable stretch variation position.

* * * * *